United States Patent [19]

Cross et al.

[11] Patent Number: 4,976,476

[45] Date of Patent: Dec. 11, 1990

[54] MANUAL AND ELECTRICAL MECHANISM FOR UNLOCKING A BOLT

[75] Inventors: David C. Cross, Shepherdsville; William G. Holloway, Lebanon Junction, both of Ky.

[73] Assignee: Monarch Hardware & Manufacturing Co., Inc., Subsidiary of Newman Tonks, Inc., Shepherdsville, Ky.

[21] Appl. No.: 366,506

[22] Filed: Jun. 13, 1989

[51] Int. Cl.[5] ..... E05B 15/02

[52] U.S. Cl. ..... 292/92; 292/21; 292/144

[58] Field of Search ..... 70/92; 292/21, 92, 201, 292/144

[56] References Cited

U.S. PATENT DOCUMENTS

| | | | |
|---|---|---|---|
| 3,767,238 | 10/1973 | Zavadzki | 292/21 |
| 3,854,763 | 12/1974 | Zawadzki | 292/201 |
| 4,167,280 | 9/1979 | Godec | 292/92 |
| 4,785,286 | 11/1988 | Martin | 292/92 |

*Primary Examiner*—Robert L. Wolfe

*Attorney, Agent, or Firm*—Cushman, Darby & Cushman

[57] ABSTRACT

An improved mechanism of simplified smaller construction for independently manually, as by a pushbar, or electrically, as by remote control, unlocking a latch bolt normally urged to locking position by a spring. The mechanism is especially adapted to be incorporated in a panic exit or fire door latch.

15 Claims, 3 Drawing Sheets

MANUAL AND ELECTRICAL MECHANISM FOR UNLOCKING A BOLT

FIELD OF THE INVENTION

This invention relates to mechanism for independently manually or electrically unlocking a latch bolt normally urged to a locking position by a spring. More particularly, the mechanism is especially adapted to be incorporated in a panic exit or fire door latch manually unlockable by a pushbar but also electrically unlockable from a remote position either to unlock the latch momentarily to permit exit and relocking of the door or to unlock the latch for extended periods of time.

BACKGROUND OF THE INVENTION

Latch mechanisms of the aforedescribed type are known and disclosed, for example, in U.S. Pat. Nos. 3,767,238 and 3,854,763 in which reference is made to still earlier U.S. patents and applications, all of which are incorporated by reference herein. Such known mechanisms, however, are rather complicated in construction with consequent increased cost of manufacture. Moreover, known pushbar operated latches which include electrical means for remote operation are rather excessive in length which limits their application to doors of considerable width.

Still further, known latch operating mechanisms of the aforedescribed type require installation with considerable precision and can easily become improperly adjusted, necessitating a service call to correct the malfunction.

SUMMARY OF THE INVENTION

Accordingly, it is an object of this invention to provide an improved mechanism for manually or electrically unlocking a latch, which mechanism is of simplified construction with consequent reduction of manufacturing costs.

Another object of this invention is to provide such a mechanism for a pushbar and electrically operated latch which is of less length than that of known mechanisms, thus allowing installation on doors of a much wider range of widths.

It is another object of this invention to provide mechanism of the aforedescribed type wherein manual and electrical operation are independent of each other, particularly as respects neither affectng the force required to operate the other.

Other objects and advantages of the invention will become apparent from the following description and accompanying drawings in which:

DETAILED DESCRIPTION OF THE PREFERRED EMBODIMENT

Figures 1, 4, 7:
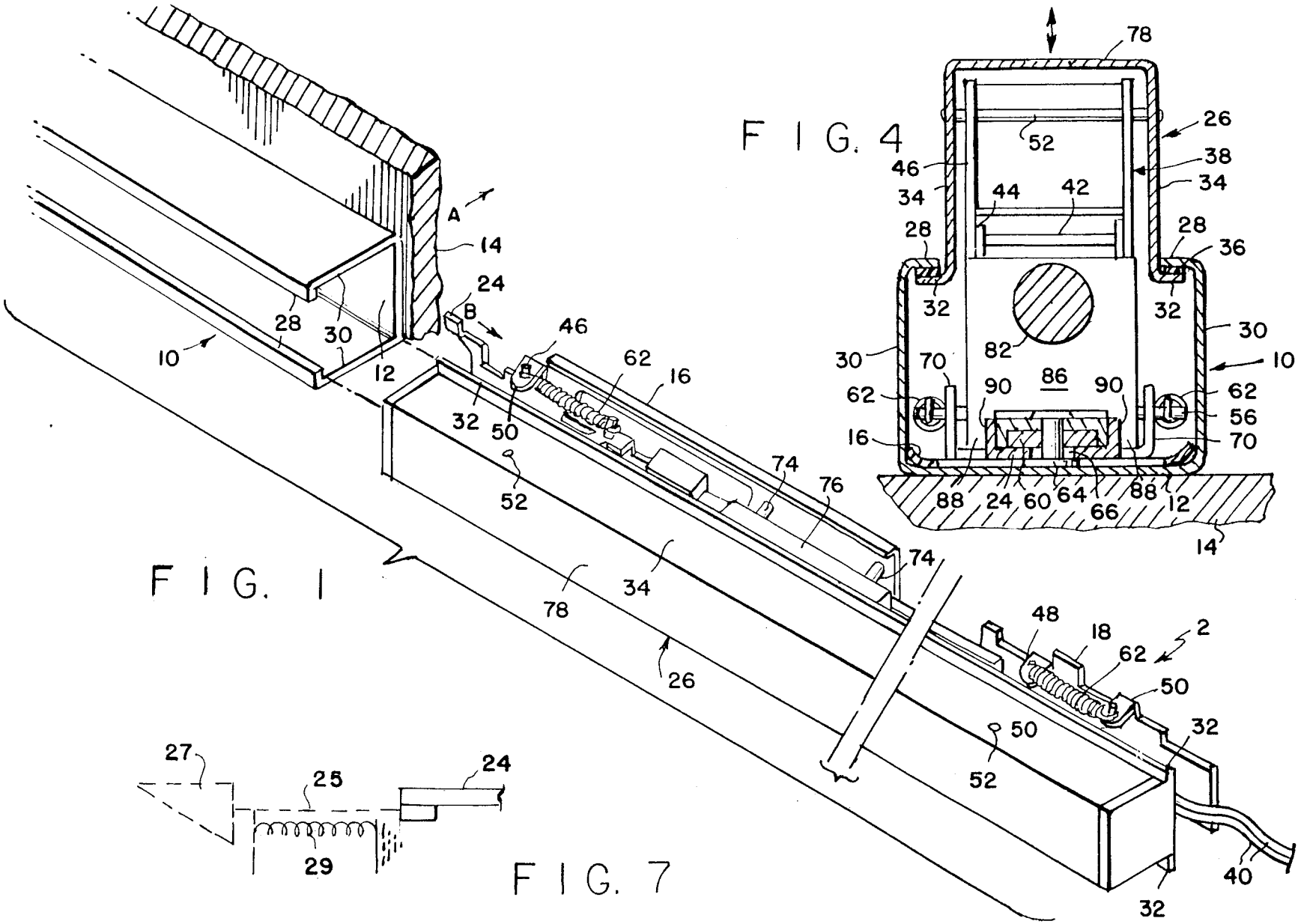
FIG. 1 is a partly exploded perspective view of pushbar or electrically operated door latch unlocking mechanism embodying this invention.
FIG. 4 is a sectional view taken on line 4—4 of FIG. 3.
FIG. 7 is a schematic fragmentary view showing a latch bolt, latch spring, and drawbar connected to the unlocking mechanism embodying this invention.

Referring now to the drawings there is shown a pushbar and electrically operated door latch unlocking mechanism of the type described. The mechanism is partially housed in a channel-shaped housing 10, the base 12 of which is adapted to be fastened as by screws or nuts and bolts (not shown) transversely across a door 14 which opens in the direction of the arrow A shown in FIG. 1. The mechanism has spaced base plates 16, 18 secured to the base 12 of the housing 10, as by screws 20 (FIG. 3) extending through countersunk holes in the housing base 12 into threaded engagement in threaded holes 22 (FIG. 2) in the base plates.

Mounted for linear movement adjacent one end of the mechanism and projecting beyond the base plate 16 is a somewhat flat and elongated linkage connector 24.

As shown diagrammatically in FIG. 7, the end of the linkage connector 24 projecting beyond the base plate 16 is adapted for connection to a conventional drawbar 25 which in turn is connected to the bolt 27 of a conventional latch for the door 14 or other closure for an opening. The latch also includes a spring 29 for urging the bolt 27 to a projected locking position into the usual keeper (not shown) or other bolt-receiving recess in the frame (not shown) for the door 14 from whence it can be moved to a retracted, unlocked position by movement of the linkage connector 2 in the direction shown by the arrow B in FIGS. 1 and 2.

The mechanism includes a channel-shaped pushbar 26 projecting out of the channel of the housing 10 and retained therein by inturned flanges 28 on the free edges of the housing side walls 30 engaging outturned flanges 32 on the free edges of the side walls 34 of the pushbar. Strips of cushioning material 36 (FIG. 4) may be interposed between the flanges 28 and 32. At one or both ends of the pusher 26, that part of the channel of the housing 10 extending there beyond may be covered by an appropriate cover (not shown).

Figure 3:
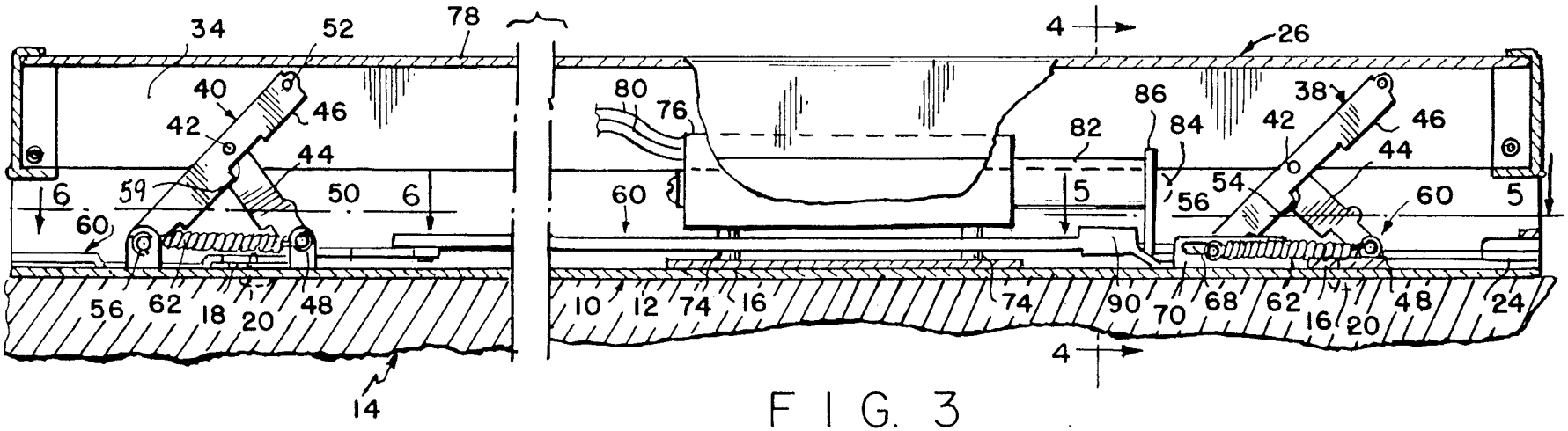
FIG. 3 is a sectional view taken on line 3—3 of FIG. 2.
Figure 5:
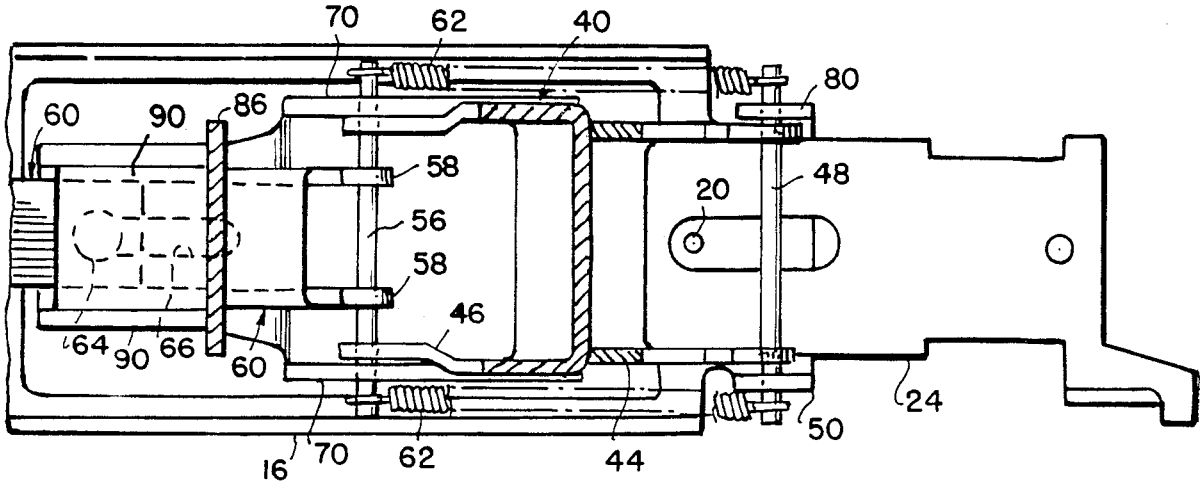
FIG. 5 is an enlarged fragmentary sectional view taken on line, 5—5 of FIG. 3.
Figure 6:
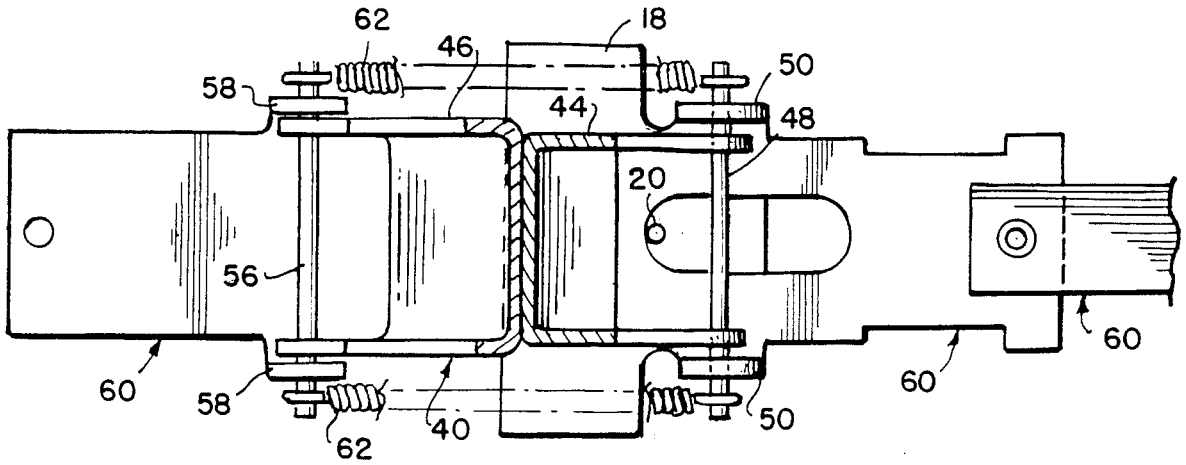
FIG. 6 is an enlarged fragmentary sectional view taken on line 6—6 of FIG. 3.

The pushbar 26 is connected to the base plates 16, 18 by two spaced identical toggles 38, 40 each having a pivot pin 42 connecting the two toggle arms 44, 46 which are generally U-shaped in cross section having side flanges joined by one or more transverse webs. A transverse pivot pin 48 connects the free end of the arm 44 of each toggle 38 or 40 to a pair of ears 50 on the corresponding base plate 16 or 18 while the free end of the other arm 46 is connected to the side walls 34 of the pushbar 26 by a transverse pivot pin 52. Interengaging stops 54 on the arms (formed by the edge of a web on the arm 44 engaging a web on the arm 46) limit the extension of each toggle 38, 40 to approximately 90° prior to assembly of the mechanism in the housing 10. After assembly, interengagement of the flanges 28 and 32 may limit such extension to less than 90°. The arm 46 of each toggle 38, 40 is extended beyond the connecting pin 42 and pivotally connected by a transverse pin 56 to a pair of ears 58 on a slide bar 60 which is mounted for linear movement as described later in detail. The pins 48 and 56 extend laterally beyond their respective ears 50 and 58 and coiled tension springs 62 are connected to and between the extensions of the two pins 48 and 56 of each toggle 38, 40, on opposite sides thereof, to normally urge the toggles to their limited extended position as shown in FIG. 3.

It thus will be seen that pushing the bar 26 into its housing 10 collapses the toggles 38, 40 in unison against the extending force of the springs 62. It also will be seen that on such collapse the slide bar 60 will be moved linearly in the direction shown by the arrows B in FIGS. 1 and 2. The linkage connector 24 is attached to the slide bar 60 with a lost motion connection, as by a pin 64 on the bar extending through an elongated slot 66 in the connector, best shown in FIG. 2. The linkage connector 24 may also have a lost motion connection with the slide bar 60 by the lateral extensions of the pin 56 of the toggle 38 extending through elongated slots 68 in side flanges 70 on the connector which straddle the arm 46 of the toggle. The connector 24 also is guided for linear movement by extending between the base plate 16 and the pins 48 and 56.

Figure 2:
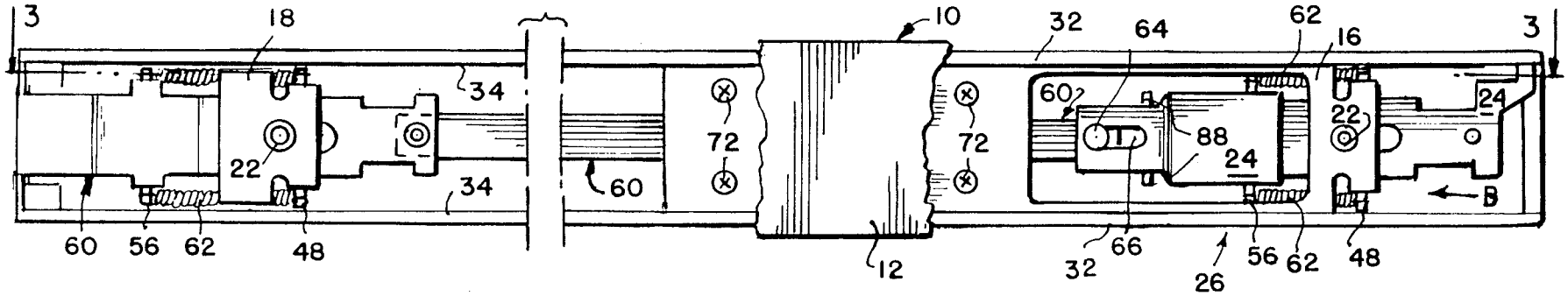
FIG. 2 is a view of the mechanism shown in FIG. 1 taken in the direction of the arrow 2 in that figure, with the parts assembled and with parts broken away to show details.

It thus will be seen that a manual push on the pushbar 26, by effecting linear movement of the linkage connector 24, and the drawbar 25 for retracting the latch bolt 27, in the direction shown by the arrow B in FIGS. 1 and 2, will unlock the latch, while release of the pushbar will return it, by the springs 62 extending the toggles 38, 40, to its position fully projecting out of the housing 10, as limited by interengagement of the flanges 32 and 28, and allow the latch bolt 27 to return to its locked position by the urging of the spring 29 in the latch.

The base plate 16 is extended in the direction of the other base plate 18 and has secured thereto, as by screws 72 and spacers 74 which straddle the slide bar 60, a solenoid 76 which is housed at least partially within the pushbar 26 when the latter is in its fully projected position. There is considerable clearance between the solenoid 76 and the top or base 78 of the pushbar 26 when the latter is in its fully projected or unpushed condition, as shown in FIG. 3, so that the solenoid will not interfere with manual operation of the pushbar to unlock the door 14 to which it is attached. The solenoid 76 includes the usual electrical winding (not shown) from which connecting wires 80 extend to a remote location and also an armature 82 which projects out of one end of the solenoid and is urged to retract therein when the winding is energized. Secured to the outer end of the armature 82, as by screw 84, is a plate 86 which extends toward the slide bar 60 and has a notch therein to provide fingers 88 which straddle the bar 60 on opposite sides thereof. The linkage connector 24 extends toward the toggle 40 between the slide bar 60 and the base plate 16 and has side flanges 90 which straddle the bar 60 and extend toward the armature 82 between the plate 88 and the body of the solenoid 76. One end of the flanges 90 provide abutments to be engaged by the fingers 88 on the plate 86.

The arrangement is such that when the linkage connector 24 is in its locking position the flanges 90 engage the fingers 88 and move the armature 82 out of the solenoid 76 when the latter is deenergized, but the fingers 88 and the flanges 90 provide a lost motion connection between the armature and the linkage connector so that the latter may be moved independently of the solenoid by the pushbar 26 but at the same time the linkage connector can be moved to its unlocking position by energization of the solenoid independently of the pushbar.

The force required to unlock the door 14 against the locking force of the spring 29 in the door latch, i.e. to move the connector 24 to its unlocking position, is greater than that required to maintain the connector in its unlocking position against the urging action of the aforesaid spring. To take advantage of this situation, the solenoid 76 is of an especially designed type operable not only at 24 volts DC to produce a force necessary to retract the connector 24 and unlock the door but operable so at a lesser DC voltage, e.g. 5 volts DC, to produce a force sufficient to retain the connector in its bolt unlocking position. Thus the solenoid 76 may be operated by a control (not shown) at a remote location to unlock the door 14 momentarily or immediately following application of the door opening voltage of 24 volts to reduce the voltage to 5 volts to retain the latch in its unlocked position over an extended period of time. Such a voltage reduction can be automatic by known types of electrical controls or by a conventional manually operable electrical control. Such voltage reduction, of course, reduces the heat generated in the solenoid winding and allows the use of a smaller solenoid.

It thus will be seen that the objects and advantages of this invention have been fully and effectively achieved. It will be realized, however, that the foregoing specific embodiments has been disclosed only for the purpose of illustrating the principles of this invention and is susceptible of modification without departing from such principles. Accordingly, the invention includes all embodiments encompassed within the spirit and scope of the following claims:

We claim:

1. An actuator mechanism for a latch having a bolt movable between a projected locking position and a retracted unlocking position and spring means urging the bolt to the projected position, comprising:

a linkage connector adapted to be connected to a drawbar fastened to a latch bolt;

means mounting said connector for substantially linear movement between a first bolt projecting position and a second bolt retracting position;

a manually-operable pushbar channel-shaped in cross section;

a first means connecting said pushbar to said connector for moving the latter between said first and second positions;

solenoid means housed at least partially in said pushbar, and including an armature movable between a projected position corresponding to said connector first position and a retracted position corresponding to said connector second position and electric coil means which when energized moves said armature to said retracted position thereof; and second means connecting said armature to said connector to move the latter from said first position to said second position, said first connecting means including a first lost motion connection permitting movement of said connector between said first and second positions by said solenoid means independently of movement by said pushbar and said second connecting means including a second lost motion connection permitting movement of said connector between said first and second positions by said pushbar independently of movement by said solenoid.

2. The actuator mechanism defined by claim 1 wherein the solenoid means is electro-magnetically arranged such that it requires significantly less voltage to hold said armature in said retracted position thereof against the urging of the latch spring means than to move said armature to said retracted position against such urging.

3. The actuator mechanism defined by claim 1 in which the first connecting means includes two lever means connected to and spaced along the length of the push bar and the solenoid means is located between said two lever toggle means.

4. The actuator mechanism defined by claim 3 in which the first connecting means includes a slide bar connecting the two lever means and the solenoid means is located between said slide bar and the pushbar.

5. The actuator mechanism defined by claim 4 in which the lost motion connection is between the connector and the slide bar.

6. The actuator mechanism defined by claim 4 in which the lost motion connection is between the connector and one of the lever means.

7. The actuator mechanism defined by claim 1 in which the armature has a lateral projection on an end thereof and the second lost motion connection is between said projection and the connector.

8. The actuator mechanism defined by claim 1 including a housing securable to an opening closure mounting the latch, said mechanism being mounted to and at least partially enclosed within said housing, said housing having an opening therein with said push bar projecting therethrough to the exterior of said housing.

9. The actuator mechanism defined by claim 8 in which the connector mounting means includes base plate means securable to the housing, the first connecting means includes two lever means mounted to said base plate means and connected to and spaced along the length of the pushbar and the solenoid is located between said two lever means and mounted to said base plate means.

10. The actuator mechanism defined by claim 9 in which one of said lever means is mounted to said base plate means by a pivot pin and the connector mounting means includes said pin.

11. An actuator mechanism for a latch having a bolt movable between a projected locking position and a retracted unlocking position and spring means urging the bolt to the projected position, comprising:

a linkage connector adapted to be connected to a drawbar fastened to a latch bolt;

means mounting said connector for substantially linear movement between a first bolt projecting position and a second bolt retracting position;

a manually-operable pushbar channel-shaped in cross section;

a first means connecting said pushbar to said connector for moving the latter between said first and second positions;

solenoid means housed at least partially in said pushbar, and including an armature movable between a projected position corresponding to said connector first position and a retracted position corresponding to said connector second position and electric coil means which when energized moves said armature to said retracted position thereof; and second means connecting said armature to said connector to move the latter from said first position to said second position, said first connecting means including a lost motion connection permitting movement of said connector between said first and second positions by said solenoid means independently of movement by said pushbar.

12. The actuator mechanism defined by claim 3 wherein the lever means is a toggle means.

13. The actuator mechanism defined by claim 4 in which the lever means is a toggle means.

14. The actuator mechanism defined by claim 9 in which the lever means is a toggle means.

15. The actuator mechanism defined by claim 10 in which the lever means is a toggle means.

* * * * *